US006332994B1

(12) United States Patent
Karageorgiou

(10) Patent No.: US 6,332,994 B1
(45) Date of Patent: Dec. 25, 2001

(54) HIGH SPEED SPINNING OF SHEATH/CORE BICOMPONENT FIBERS

(75) Inventor: Theodore G. Karageorgiou, Arden, NC (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/504,048

(22) Filed: Feb. 14, 2000

(51) Int. Cl.[7] ..... D01D 5/16; D01D 5/253; D01D 5/34; D01F 8/04; D02G 3/02

(52) U.S. Cl. ..... 264/103; 264/172.12; 264/172.15; 264/172.17; 264/172.18; 264/210.8

(58) Field of Search ..... 264/103, 172.11, 264/172.12, 172.15, 172.17, 172.18, 177.13, 210.8

(56) References Cited

U.S. PATENT DOCUMENTS

| | | | |
|---|---|---|---|
| 4,035,879 | | 7/1977 | Schippers . |
| 4,075,378 | | 2/1978 | Anton et al. . |
| 4,085,182 | | 4/1978 | Kato . |
| 4,186,168 | | 1/1980 | Barbe et al. . |
| 4,217,321 | | 8/1980 | Campbell . |
| 4,247,270 | | 1/1981 | Schubert . |
| 4,270,888 | | 6/1981 | Kane et al. . |
| 4,318,676 | | 3/1982 | Gerking et al. . |
| 4,362,260 | | 12/1982 | Hasegawa et al. . |
| 4,424,257 | | 1/1984 | Bach . |
| 4,424,258 | | 1/1984 | Bach . |
| 4,539,170 | | 9/1985 | Hare . |
| 4,596,742 | * | 6/1986 | Selivansky et al. ..... 428/373 |
| 4,740,339 | | 4/1988 | Bach et al. . |
| 4,867,925 | | 9/1989 | Feijen et al. . |
| 4,975,325 | | 12/1990 | McKinney et al. . |
| 5,047,189 | | 9/1991 | Lin . |
| 5,093,061 | | 3/1992 | Bromley et al. . |
| 5,234,327 | | 8/1993 | Martin . |
| 5,252,158 | | 10/1993 | Shimizu et al. . |
| 5,277,855 | | 1/1994 | Blackmon et al. . |
| 5,439,364 | | 8/1995 | Gerking et al. . |
| 5,447,794 | | 9/1995 | Lin . |
| 5,505,894 | | 4/1996 | Frankfort et al. . |
| 5,558,825 | | 9/1996 | Ueda et al. . |
| 5,593,705 | | 1/1997 | Schilo et al. . |
| 5,612,063 | | 3/1997 | Schilo et al. . |
| 5,661,880 | | 9/1997 | Schippers et al. . |
| 5,688,458 | | 11/1997 | Koschinek et al. . |
| 5,698,146 | | 12/1997 | Schippers et al. . |
| 5,702,658 | | 12/1997 | Pellegrin et al. . |
| 5,750,151 | | 5/1998 | Brignola et al. . |
| 5,820,805 | | 10/1998 | Hodan . |
| 5,849,232 | | 12/1998 | Ochi et al. . |
| 5,948,528 | | 9/1999 | Helms, Jr. et al. . |
| 6,162,382 | * | 12/2000 | Kent et al. ..... 264/172.12 |

FOREIGN PATENT DOCUMENTS

| | | |
|---|---|---|
| 0 200 701 A2 | 11/1986 | (EP) . |
| 0 200 702 A3 | 11/1986 | (EP) . |
| 0 248 598 A2 | 12/1987 | (EP) . |
| 0 596 849 A1 | 9/1996 | (EP) . |
| 0 730 049 A1 | 9/1996 | (EP) . |
| 1 059 372 A2 | 12/2000 | (EP) . |

* cited by examiner

*Primary Examiner*—Leo B. Tentoni
(74) *Attorney, Agent, or Firm*—Nixon & Vanderhye P.C.

(57) ABSTRACT

Processes whereby sheath/core bicomponent fibers are melt-spun at relatively high spinning rates. In particularly preferred forms, polyamide sheath/core bicomponent fibers are made at melt-spinning speeds of about 4000 meters per minute or greater, and more preferably about 4500 meters per minute or greater. Most preferably, the sheath is formed of nylon 6,12 while the core is formed of nylon 6.

21 Claims, No Drawings

HIGH SPEED SPINNING OF SHEATH/CORE BICOMPONENT FIBERS

FIELD OF THE INVENTION

The present invention relates generally to melt-spinning of synthetic fibers. More specifically, the present invention relates to melt-spinning processes by which sheath/core bicomponent polyamide fibers are produced.

BACKGROUND AND SUMMARY OF THE INVENTION

Polyamide fibers are relatively inexpensive and offer a combination of desirable qualities such as comfort, warmth and ease of manufacture into a broad range of colors, patterns and textures. As a result, polyamide fibers are widely used in a variety of household and commercial articles, including, for example, carpets, drapery material, upholstery and clothing. Carpets made from polyamide fibers are a popular floor covering for both residential and commercial applications.

Sheath/core polyamide fibers are, in and of themselves, well known. For example, U.S. Pat. No. 5,447,794 (incorporated by reference herein) discloses sheath/core polyamide filaments which are resistant to staining. According to the '794 patent, the core component may be nylon 6, nylon 6,6 and copolymers thereof, while the sheath component may be high carbon nylons, such as nylon 12,12, nylon 6,12, nylon 6,10, nylon-11 and the like.

The current wisdom in the fiber-spinning art is that conventional sheath/core polyamide bicomponent fibers must be melt-spun at relatively slow melt-spinning speeds. In this regard, relatively low speed spinning of sheath/core bicomponent fibers is thought to be necessary in order to ensure that the sheath component provides complete coverage of the core component (i.e., so that the sheath component completely surrounds the core component along the entirety of the fiber length). For example, the '794 patent discloses that spinning speeds of less than 500 meters per minute were employed. (See, column 5, lines 23–24 of the '794 patent.)

Because of the attractive properties that sheath/core polyamide bicomponent fibers have or can be made to have, it would be highly desirable if they could be melt spun at relatively high melt-spinning rates, for example, about 4000 meters per minute or greater, and more preferably about 4500 meters per minute or greater. High speed spinning of bicomponent fibers would thus greatly contribute to lower cost fiber production. It is towards fulfilling such a need that the present invention is directed.

Broadly, the present invention is embodied in processes whereby sheath/core bicomponent fibers are melt-spun at relatively high spinning rates. In particularly preferred forms, the present invention is embodied in melt-spinning polyamide sheath/core bicomponent fibers at melt-spinning speeds of about 4000 meters per minute or greater, and more preferably about 4500 meters per minute or greater. Most preferably, the sheath is formed of nylon 6,12 while the core is formed of nylon 6.

These and other aspects and advantages will become more apparent after careful consideration is given to the following detailed description of the preferred exemplary embodiments thereof.

DETAILED DESCRIPTION OF THE INVENTION

As used herein and in the accompanying claims, the term "fiber-forming" is meant to refer to polymers which are capable of being formed into a fiber structure having a length at least 100 times its width. The term "fiber" includes fibers of extreme or indefinite length (filaments) and fibers of short length (staple). The term "yarn" refers to a continuous strand or bundle of fibers. The term "bicomponent fiber" is a fiber having at least two distinct cross-sectional domains respectively formed of different polymers and is therefore intended to include concentric and eccentric sheath-core fiber structures.

Virtually any melt-spinnable polymer may be employed in the practice of the present invention. Classes of suitable polymeric materials include polyamides, polyesters, acrylics, olefins, maleic anhydride grafted olefins, and acrylonitriles.

The preferred polymers used in forming the core and sheaths of the bicomponent fibers of this invention are polyamides. In this regard, those preferred polyamides are generically known by the term "nylon" and are long chain synthetic polymers containing amide (-CO-NH-) linkages along the main polymer chain. Suitable melt spinnable, fiber-forming include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ϵ-caprolactam (nylon 6) and polyhexamethylene adipamide (nylon 6/6). Most preferred is nylon 6. The preferred polyamides will exhibit a relative viscosity of between about 2.0 to about 4.5, preferably between about 2.4 to about 4.0.

The fiber-forming polymers used to form the core and sheath of the bicomponent fibers are different from one another. The particular fiber-forming polymer that is used may be selected based on the final fiber physical property that may be desired. Most preferably, the core polymer is nylon 6 and the sheath polymer is nylon 6,12.

Most preferably, the sheath is relatively thin as compared to the core. That is, the sheath polymer completely surrounds the core polymer and accounts for less than about 30 wt. %, usually less than about 15 wt. %, and typically less than about 10 wt. % of the total fiber weight. Most preferably, the sheath polymer is present in an amount between about 3 wt. % to about 30 wt. %, typically between about 3 wt. % to about 15 wt. % and usually between about 3 wt. % to about 10 wt. % of the total fiber weight. Conversely, the core polymer is present in an amount of between greater than about 70 wt. % to about 97 wt. %, usually between about 85 wt. % to about 97 wt. %, and usually between about 90 wt. % to about 97 wt. % of the total fiber weight.

The sheath-core fibers are spun using conventional fiber-forming equipment. Thus, for example, separate melt flows of the sheath and core polymers may be fed to a conventional sheath-core spinnerette pack such as those described in U.S. Pat. Nos. 5,162,074, 5,125,818, 5,344,297 and 5,445,884 (the entire content of each patent being incorporated expressly hereinto by reference) where the melt flows are combined to form extruded multi-lobal (e.g., tri-, tetra-, penta- or hexalobal) fibers having sheath and core structures. Preferably, the fibers have a trilobal structure with a modification ratio of at least about 2.0, more preferably between 2.2 and 4.0. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section. The fibers could also have a substantially circular cross-section (i.e., a modification ratio of substantially about 1.0).

The extruded fibers are quenched, for example with air, in order to solidify the fibers. The fibers may then be treated with a finish depending on the particular end-use application envisioned. For example, the fibers may be treated with a finish which comprises a lubricating oil or mixture of oils and antistatic agents. The thus formed fibers are then combined to form a yarn bundle which is then wound on a suitable package.

While the melt-spinning equipment is conventional, the spinning speed employed to spin the bicomponent fibers of this invention is quite unconventional. Specifically, unlike the prior art, the present invention melt-spins the bicomponent fibers at relatively high melt-spinning rates. Preferably, the fibers are melt-spun at rates of about 4000 meters per minute or greater, and more preferably about 4500 meters per minute or greater.

The fibers of the present invention may be subject to virtually any desired post-spinning process. For example, the fibers may be oriented following spinning. If oriented, it is preferred that the orientation occurs immediately following melt-spinning (i.e., a one-step spinning and orientation process). Most preferably, the fibers of the present invention are at least partially oriented and formed into yarns (i.e., known colloquially as partially oriented yarns (POY)). That is, multiple ends of the fibers are simultaneously melt-spun and then immediately oriented in a one-step process at draw ratio sufficient to achieve at least about 45% fiber elongation, and preferably at least about 60% elongation.

The present invention will be further understood from the following non-limiting Example.

EXAMPLES

Sheath/core bicomponent partially oriented yarns (POY) were produced at 4500 mpm using nylon 6,12 as the sheath component and nylon 6 as the core component. 40 denier/10 filament, trilobal cross-section yarns were made at the following sheath core ratios: 5/95, 15/85 and 30/70. A single component nylon 6 yarn was also made as a control. The nylon 6,12 and nylon 6 polymers were extruded from different extruders that had the same heating temperature profile (260° C.–269° C.). The polymer temperatures at the die heads were about 269° C. The two separate polymer streams were combined in the spin pack using the principles described in U.S. Pat. No. 5,344,297 to Hills (incorporated hereinto by reference) to produce bicomponent fibers. The threadlines were air quenched, lubricated and interlaced prior to winding. A high speed winder (Barmag).was used to wind the yarns at 4500 mpm.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for making bicomponent fibers comprising melt-spinning first and second polymer streams at a melt-spinning speed of about 4000 meters per minute or greater to form a bicomponent fiber having first and second fiber domains corresponding to said first and second polymer streams, respectively, and having a modification ratio of at least about 2.0.

2. The process of claim 1, wherein said step of melt-spinning includes melt-spinning said first and second polymer streams into a sheath/core bicomponent fiber wherein said first polymer stream forms a core domain of said bicomponent fiber, and said second polymer stream forms a sheath domain of said bicomponent fiber which completely surrounds said core domain.

3. The process of claim 1 or 2, wherein said first and second polymers are different.

4. The process of claim 3, wherein each of said first and second polymers is selected from the group consisting of polyamides, polyesters, acrylics, olefins, maleic anhydride grafted olefins, and acrylonitriles.

5. The process of claim 3, wherein each of said first and second polymers is selected from the group consisting of nylon 6, nylon 6/6, nylon 6/9, nylon 6/10, nylon 6T, nylon 6/12, nylon 11, nylon 12, nylon 4,6 and copolymers and mixtures thereof.

6. The process of claim 1 or 2 wherein said first polymer stream is nylon 6 and said second polymer stream is nylon 6,12.

7. The process of claim 6, wherein said step of melt-spinning is about 4500 meters per minute or greater.

8. The process of claim 6, wherein said core is between about 70 to about 97 wt. % of the total bicomponent fiber weight, and said sheath is between about 3 to about 30 wt. % of the total bicomponent fiber weight.

9. The process of claim 6, wherein the bicomponent fibers are multilobal and have a modification ratio of between about 2.2. to about 4.0.

10. The process of claim 1 or 2, further comprising drawing the bicomponent fiber to achieve a fiber elongation of least about 45%.

11. The process of claim 1 or 2, further comprising drawing the bicomponent fiber to achieve a fiber elongation of least about 60%.

12. A process for making partially oriented yarns comprised of multiple bicomponent filaments comprising (i) melt-spinning multiple first and second polymer streams at a melt-spinning speed of about 4000 meters per minute or greater to form multiple bicomponent fibers each having first and second fiber domains corresponding to said first and second polymer streams, respectively, and having a modification ratio of at least about 2.0, (ii) drawing the multiple bicomponent fibers to achieve a fiber elongation of least about 60%, and (iii) collecting the multiple bicomponent fibers to form a yarn thereof.

13. The process of claim 12, wherein step (iii) is practiced before step (ii).

14. The process of claim 13, wherein said step of melt-spinning includes melt-spinning said first and second polymer streams into a sheath/core bicomponent fiber wherein said first polymer stream forms a core domain of said bicomponent fiber, and said second polymer stream forms a sheath domain of said bicomponent fiber which completely surrounds said core domain.

15. The process of claim 14, wherein said first and second polymers are different.

16. The process of claim 15, wherein each of said first and second polymers is selected from the group consisting of polyamides, polyesters, acrylics, olefins, maleic anhydride grafted olefins, and acrylonitriles.

17. The process of claim 16, wherein each of said first and second polymers is selected from the group consisting of nylon 6, nylon 6/6, nylon 6/9, nylon 6/10, nylon 6T, nylon 6/12, nylon 11, nylon 12, nylon 4,6 and copolymers and mixtures thereof.

18. The process of claim 14, wherein said first polymer stream is nylon 6 and said second polymer stream is nylon 6,12.

19. The process of claim 14 or 18, wherein said step of melt-spinning is about 4500 meters per minute or greater.

20. The process of claim 14 or 18, wherein said core is between about 70 to about 97 wt. % of the total bicomponent fiber weight, and said sheath is between about 3 to about 30 wt. % of the total bicomponent fiber weight.

21. The process of claim 14 or 18, wherein the bicomponent fibers are multilobal and have a modification ratio of between about 2.2. to about 4.0.

* * * * *